US007157137B2

(12) United States Patent
Wenstrup

(10) Patent No.: US 7,157,137 B2
(45) Date of Patent: Jan. 2, 2007

(54) VARIED DENSITY NONWOVEN

(75) Inventor: David Edward Wenstrup, Easley, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 10/910,469

(22) Filed: Aug. 3, 2004

(65) Prior Publication Data

US 2005/0070194 A1 Mar. 31, 2005

Related U.S. Application Data

(63) Continuation of application No. 10/057,568, filed on Oct. 29, 2001, now abandoned.

(51) Int. Cl.
*B32B 7/02* (2006.01)
*D04H 1/46* (2006.01)

(52) U.S. Cl. ..... 428/218; 442/364; 442/409; 442/411; 442/415

(58) Field of Classification Search ..... 428/218; 442/364, 415
See application file for complete search history.

(56) References Cited

U.S. PATENT DOCUMENTS

| | | | | |
|---|---|---|---|---|
| 3,681,183 | A | 8/1972 | Kalwaites | 161/109 |
| 4,532,173 | A | 7/1985 | Suzuki et al. | 428/218 |
| 5,246,772 | A | 9/1993 | Manning | 428/284 |
| 5,275,865 | A | 1/1994 | Nicolay | 428/174 |
| 5,582,603 | A | 12/1996 | Difilippantonio et al. | 604/380 |
| 5,646,077 | A | 7/1997 | Matsunaga et al. | 442/415 |
| 5,741,380 | A | 4/1998 | Hoyle et al. | 156/62.6 |
| 6,075,682 | A | 6/2000 | Howey | 360/133 |
| 6,777,056 | B1 * | 8/2004 | Boggs et al. | 428/58 |
| 2001/0003151 | A1 * | 6/2001 | Wallstrom | 604/380 |

* cited by examiner

*Primary Examiner*—Jenna Befumo
(74) *Attorney, Agent, or Firm*—Terry T. Moyer; Robert M. Lanning

(57) ABSTRACT

A nonwoven having varying densities of the fibers that make up the nonwoven. The nonwoven has a length direction x, a width direction y, and a thickness direction z. The density of the fibers 11 in the nonwoven 10 varies long the width direction y of the nonwoven 10.

14 Claims, 2 Drawing Sheets

VARIED DENSITY NONWOVEN

CROSS-REFERENCE TO RELATED APPLICATIONS

This application is a continuation of prior U.S. application Ser. No. 10/057,568, filed on Oct. 29, 2001, now abandoned, the contents of all of which are incorporated by reference herein in their entirety.

BACKGROUND

The present invention generally relates to moldable nonwoven materials, and in particular, to moldable nonwoven materials for use in applications having varying requirements in each area of the component.

A nonwoven mat formed of low and high melt polyester fibers can be molded into a form for various components such as automotive headliners. This nonwoven has the advantage of being formable, resilient to treatment in the car manufacturing process, and when combined with a 100% polyester A-surface fabric, recyclable. However, it has been found by the present inventors that the performance of components does not always need to be the same in all areas of the component. Therefore, there is a need for moldable nonwoven materials that can satisfy the varying performance requirements of a component in different zones and reduce the weight and raw material cost of the component.

BRIEF DESCRIPTION OF THE DRAWINGS

For a more complete understanding of the present invention, reference should be made to the following drawings in conjunction with the detailed description below.

DETAILED DESCRIPTION

Figure 1:
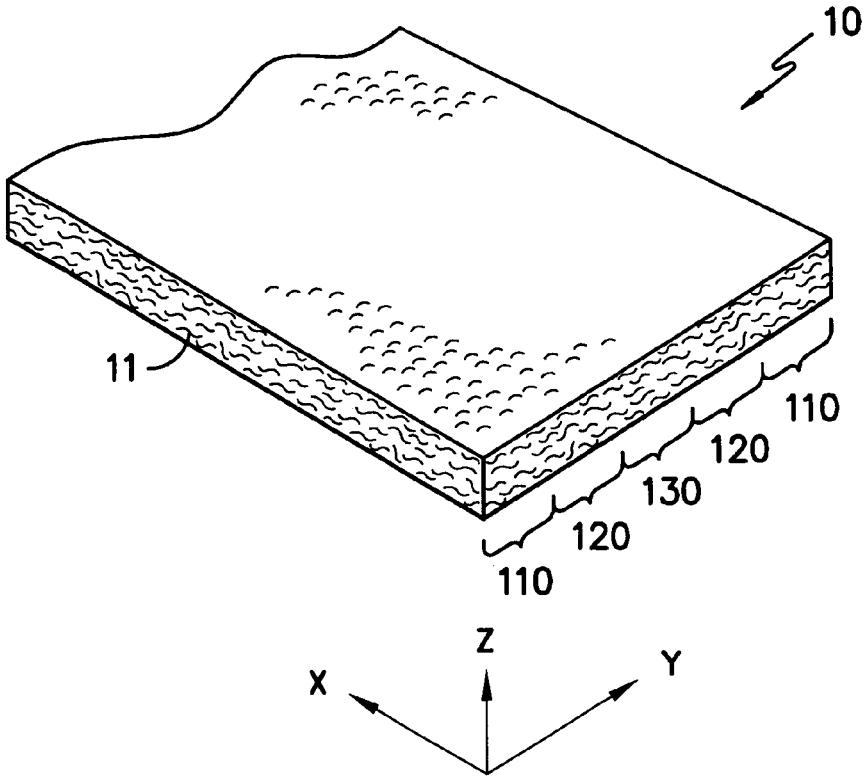
FIG. 1 is a perspective view of a nonwoven material of the present invention; and, FIG. 2 is a cross sectional view of one embodiment of the nonwoven in FIG. 1, prior to needle punching.

Referring now to the Figures, and in particular to FIG. 1, there is shown an embodiment of the present invention illustrated as the nonwoven 10 formed of staple fibers 11. The nonwoven 10 has a length direction x, a width direction y, and a thickness direction z. The x direction is typically the machine direction, the y direction is typically the cross machine direction, and the z direction is typically the thickness of the nonwoven 10. As such, the x direction (or machine direction) is typically greater than the y direction (or cross machine direction), and the y direction (or cross machine direction) is typically greater than the z direction (or thickness).

The nonwoven 10 comprises first sections 110, second sections 120, and a third section 130, disposed across the width direction y of the nonwoven 10, and along the length direction x of the nonwoven 10. The second sections 120 are disposed on opposite sides of the third section 130, which all extend in the length direction x. The first sections 110 are disposed on the sides of the second sections 120 opposite to the third section 130, and which also extend in the length direction x.

In one embodiment, the fibers 11 forming the nonwoven 10 are a synthetic polymeric fiber. In a further embodiment, the fibers 11 forming the nonwoven 10 are a combination of high melt polyester and low melt polyester fibers. In a further embodiment, the low melt polyester fibers are a core/sheath fiber, with sheath melt temperature of from about 110° C. to about 180° C., with standard polyester core. The core/sheath fiber is used with the standard matrix fiber. The low melt polyester fiber, or core/sheath fiber, can comprise from about 40% to about 90% by weight of the total blend of fibers 11 in the nonwoven 10, and the high melt polyester fibers, or matrix fibers, can vary from about 60% to about 10% by weight of the total blend of fibers 11 in the nonwoven 10, depending on desired final properties required of nonwoven 10. The use of low melt temperature fibers facilitates the molding of component parts from the nonwoven of the present invention after formation of that nonwoven material.

Figure 2:
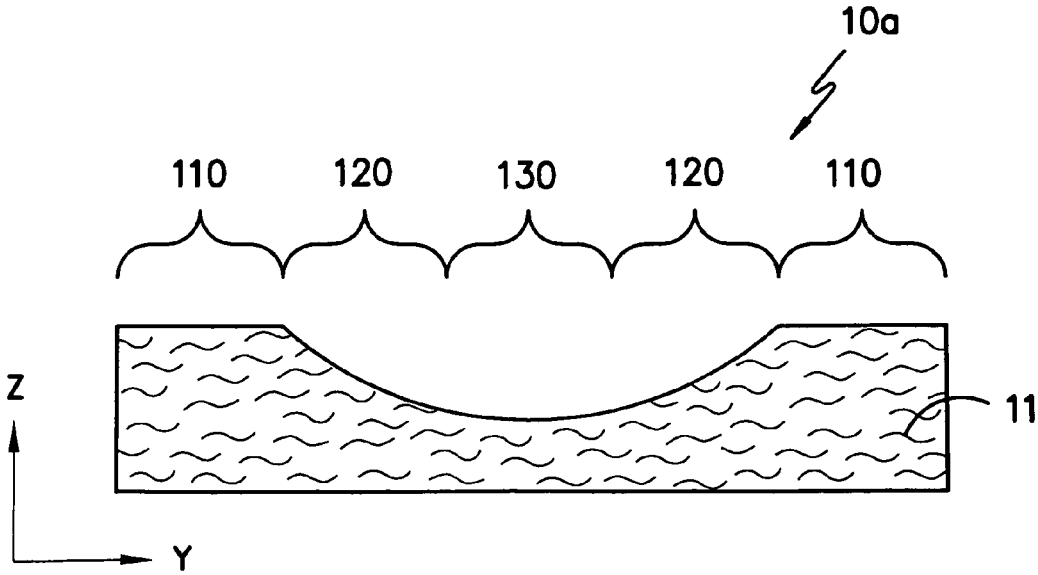
Figure 3:
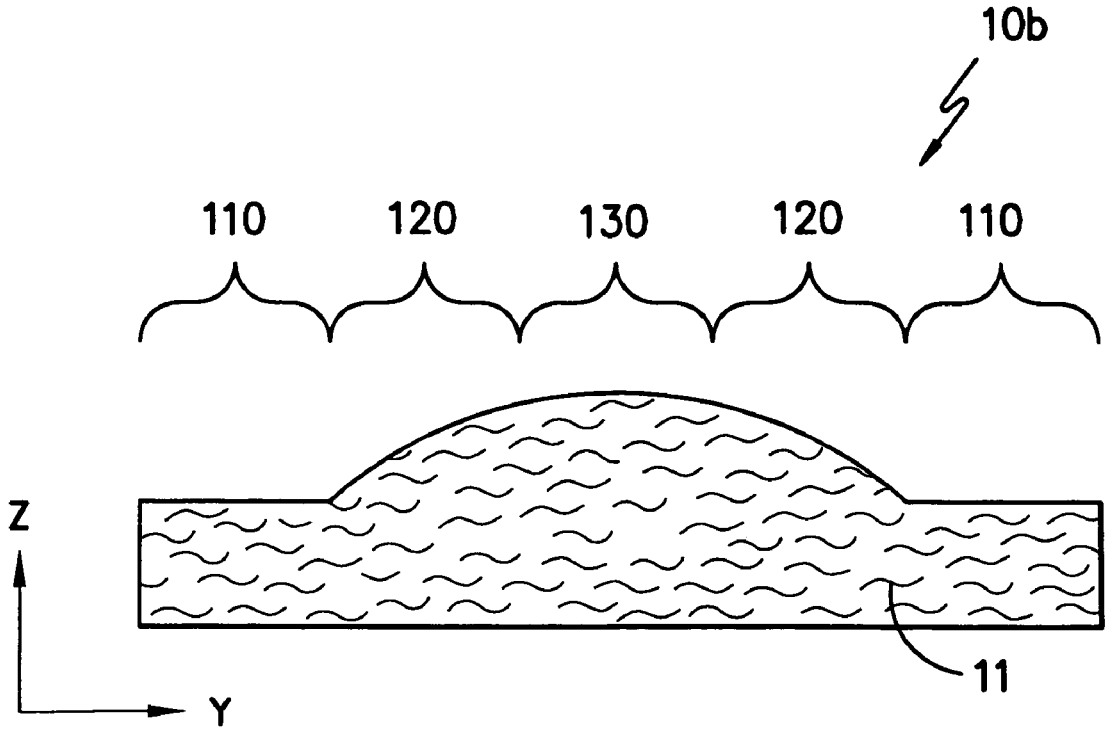
FIG. 3 is a cross sectional view of another embodiment of the nonwoven in FIG. 1, prior to needle punching.

Referring now to FIGS. 2 and 3, there are shown cross sectional views of nonwoven battens 10*a* and 10*b* used to form the nonwoven 10 in FIG. 1. The nonwoven battens 10*a* and 10*b* are in a loose web form prior to the needling required to form the nonwoven 10 in FIG. 1. The width direction y, and the thickness direction z are also illustrated on the nonwoven battens 10*a* and 10*b*. The nonwoven battens 10*a* and 10*b* include the first zones 110, the second zones 120, and the third zone 130 which correspond to the same zones in the nonwoven 100.

As illustrated in FIG. 2, the first zones 110 of the batten 10*a* have a greater weight of fibers 11 per width y than the second zones 120 or the third zone 130, and the second zones 120 have a greater weight of the fibers 11 per width y than the third zone 130. Additionally, the second zone 120 has varying amounts of fibers 11 per width y, across the width y of the second zone 120, with the greater amounts being adjacent to the first zones 110 and decreasing to the lower amounts adjacent to the third zone 130. In one embodiment, the fiber density is approximately uniform in the creation of the batten 10*a*. In this manner, the thickness z of the batten 10*a* will vary across the width y of the batten 10*a*, with the first zones 110 having greater thickness z than the second zones 120 and the third zone 130, and the second zones 120 having greater thickness z than the third zone 130.

As illustrated in FIG. 3, the third zone 130 of the batten 10*b* has a greater weight of fibers 11 per width y than the second zones 120 or the first zones 110, and the second zones 120 have a greater weight of the fibers 11 per width y than the first zones 110. Additionally, the second zone 120 has varying amounts of fibers 11 per width y, across the width y of the second zone 120, with the greater amounts being adjacent to the third zone 130 and decreasing to the lower amounts adjacent to the first zones 110. In one embodiment, the fiber density is approximately uniform in the creation of the batten 10*b*. In this manner, the thickness z of the batten 10*b* will vary across the width y of the batten 10*b*, with the third zone 130 having greater thickness z than the second zones 120 and the first zones 110, and the second zones 120 having greater thickness z than the first zones 110.

Referring back now to FIG. 1, there is shown a cross sectional view of the nonwoven 10 after needling of the nonwoven batten 10*a* or 10*b* illustrated in FIGS. 2 and 3. In forming the nonwoven 10, the batten 10*a* or 10*b* is needled to give the nonwoven 10 a structural integrity. The needling of the pre-laid batten 10*a* or 10*b* causes the various zones 110, 120, and 130 of the batten 10*a* or 10*b* to be connected by the intertwining of fibers 11 between the various zones 110, 120, and 130, in the same manner that various areas within the particular zones remain integrally connected. The connection of the different zones is accomplished by the intertwining of fibers between the adjacent zones. In cases which require the nonwoven 10 to have a very flat surface and the z direction to be uniform across the y direction of the nonwoven 10 to be uniform, different needle densities can be used across the needle board to effectively give the nonwoven 10 a variable needled density across width y. In the embodiment illustrated in FIG. 1, the nonwoven 10 has substantially a uniform thickness z across the width y.

In the embodiment of the nonwoven 10 formed from the batten 10*a*, first zones 110 have a greater density of the fibers 11 than the second zones 120 and the third zone 130, and the second zones 120 have a greater density of the fibers 11 than the third zone 130. Additionally, the second zone 120 has a density of the fibers 11 that varies within the particular zone, the greatest density being adjacent to the first zones 110, and reducing in densities towards the third zone 130.

In the embodiment of the nonwoven 10 formed from the batten 10*b*, the first zones 110 have a lesser density of the fibers 11 than the second zones 120 and the third zone 130, and the second zones 120 have a lesser density of the fibers 11 than the third zone 130. Additionally, the second zone 120 has a density of the fibers 11 that varies within the particular zone, the greatest density being adjacent to the third zone 130, and reducing in densities towards the first zones 110.

The present invention provides a nonwoven having different characteristics in different zones and using a minimum of material to obtain those characteristics, thereby minimizing raw material cost, and reducing the weight of the nonwoven to achieve the desired performance.

The invention claimed is:

1. A nonwoven article comprising a plurality of intertwined fibers and having a width, length, and thickness, wherein the thickness of the nonwoven article is substantially uniform across the width, and wherein the nonwoven article further comprises a first zone having a width extending across a portion of the width of the nonwoven article and a second zone adjacent to the first zone and having a width extending across a portion of the width of the nonwoven article, the first zone having a first density of the fibers therein, the first density being substantially uniform across the width of the first zone, and the second zone having a density of the fibers therein, the density of the fibers in the second zone varying across the width of the second zone according to a gradient exhibiting a maximum density adjacent to the first zone.

2. The nonwoven article according to claim 1, wherein the first zone and the second zone are connected by the intertwining of the fibers between the first zone and the second zone.

3. The nonwoven article according to claim 1, wherein the fibers forming the nonwoven comprise a plurality of high melt polyester fibers and a plurality of low melt polyester fibers.

4. The nonwoven article according to claim 1, wherein the fibers forming the nonwoven comprise a plurality of high melt polyester fibers and a plurality of core sheath polyester fibers having a low melt polyester sheath.

5. The nonwoven article according to claim 4, wherein the low melt polyester sheath has a melt temperature from about 100° C. to about 180° c.

6. The nonwoven article according to claim 4, wherein the core sheath polyester fibers comprise from about 40% to about 90% by weight of the fibers forming the nonwoven.

7. The nonwoven article according to claim 4, wherein the high melt polyester fibers comprise from about 40% to about 10% by weight of the fibers forming the nonwoven.

8. A nonwoven article comprising a plurality of intertwined fibers and having a width, length, and thickness, wherein the thickness of the nonwoven article is substantially uniform across the width, and wherein the nonwoven article further comprises a first zone having a width extending across a portion of the width of the nonwoven article and a second zone adjacent to the first zone and having a width extending across a portion of the width of the nonwoven article, the first zone having a first density of the fibers therein, the first density being substantially uniform across the width of the first zone, and the second zone having a density of the fibers therein, the density of the fibers in the second zone varying across the width of the second zone according to a gradient exhibiting a minimum density adjacent to the first zone. along the width than either the first zone or the second zone.

9. The nonwoven article according to claim 8, wherein the first zone and the second zone are connected by the intertwining of the fibers between the first zone and the second zone.

10. The nonwoven article according to claim 8, wherein the fibers forming the nonwoven comprise a plurality of high melt polyester fibers and a plurality of low melt polyester fibers.

11. The nonwoven article according to claim 8, wherein the fibers forming the nonwoven comprise a plurality of high melt polyester fibers and a plurality of core sheath polyester fibers having a low melt polyester sheath.

12. The nonwoven article according to claim 11, wherein the low melt polyester sheath has a melt temperature from about 110°C. to about 180°C.

13. The nonwoven article according to claim 11, wherein the core sheath polyester fibers comprise from about 40% to about 90% by weight of the fibers forming the nonwoven.

14. The nonwoven article according to claim 11, wherein the high melt polyester fibers comprise from about 40% to about 10% by weight of the fibers forming the nonwoven.

* * * * *

UNITED STATES PATENT AND TRADEMARK OFFICE

CERTIFICATE OF CORRECTION

PATENT NO. : 7,157,137 B2
APPLICATION NO. : 10/910469
DATED : January 2, 2007
INVENTOR(S) : David Edward Wenstrup It is certified that error appears in the above-identified patent and that said Letters Patent is hereby corrected as shown below:

In the Claims:

Column 4, line 7, delete "100°C. to about 180° c." and insert --110°C. to about 180°C.--

Column 4, line 28 - 29, delete "along the width than either the first zone or the second zone."

Signed and Sealed this

Thirteenth Day of March, 2007

JON W. DUDAS
*Director of the United States Patent and Trademark Office*